US006834925B2

(12) United States Patent
Ikeda

(10) Patent No.: US 6,834,925 B2
(45) Date of Patent: Dec. 28, 2004

(54) RECORDING APPARATUS

(75) Inventor: Yasuhiko Ikeda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 619 days.

(21) Appl. No.: 09/905,101

(22) Filed: Jul. 16, 2001

(65) Prior Publication Data

US 2002/0057301 A1 May 16, 2002

(30) Foreign Application Priority Data

Jul. 21, 2000 (JP) ..... 2000-220623
Jul. 2, 2001 (JP) ..... 2001-200736

(51) Int. Cl.[7] ..... B41J 25/308
(52) U.S. Cl. ..... 347/8; 347/37; 347/86
(58) Field of Search ..... 347/8, 14, 19, 347/80, 37, 86; 400/56, 57

(56) References Cited

U.S. PATENT DOCUMENTS 5,859,653 A 1/1999 Aoki et al. ..... 347/8
5,988,784 A * 11/1999 Takemura et al. ..... 347/8
6,419,409 B1 7/2002 Ueda et al. ..... 400/56

FOREIGN PATENT DOCUMENTS

| | | |
|---|---|---|
| EP | 0 864 426 | 9/1998 |
| EP | 0 982 146 | 1/2000 |
| JP | 6-344624 | 12/1994 |
| JP | 8-52922 | 2/1996 |
| JP | 9-277642 | 10/1997 |

* cited by examiner

*Primary Examiner*—Hai Pham
*Assistant Examiner*—Lam S Nguyen
(74) *Attorney, Agent, or Firm*—Fitzpatrick, Cella, Harper & Scinto

(57) ABSTRACT

The recording apparatus can detect the gap between a recording head and the back surface of a recording medium and can record optimum images according to the detected gap. To this end, the ink-jet recording apparatus includes a carriage for serially moving a recording head, a position detector for detecting the position of the carriage, an adjusting device for adjusting the gap between the recording head and the back surface of the recording medium located at a position opposing the recording head, and a recognizing unit for recognizing a state of the adjusting device based on information from the position detector.

6 Claims, 7 Drawing Sheets

THICK - PAPER POSITION

THIN - PAPER POSITION

THICK-PAPER POSITION

THIN-PAPER POSITION

RECORDING APPARATUS

BACKGROUND OF THE INVENTION

1. Field of the Invention

The present invention relates to a recording apparatus capable of recording while maintaining a suitable gap between a recording head and a recording surface of recording media with various thicknesses.

2. Description of the Related Art

A recording apparatus having functions of a printer, a copying machine, a facsimile machine, etc., or a recording apparatus used for an output terminal of a complex-type electronic apparatus or a workstation having computers and word processors therein is constructed so as to record an image on a recording member (recording medium) such as a paper sheet or a plastic sheet on the basis of image information. Such a recording apparatus may be classified into types of inkjet, wire-dot-matrix, matrix, thermal, laser beam, and so forth.

On the other hand, demands for a material of the recording member are diversified, so that it has been required to form images on a thin paper sheet and a converted paper sheet (such as a paper sheet for filing with punched holes, a paper sheet perforated for tearing-off, and a paper sheet with an arbitrary size) as well as on an ordinary recording member such as a paper sheet and a resin sheet (OHP, etc.).

In the recording apparatuses described above, however, there are some apparatuses that cannot have images with desired recording quality without maintaining a suitable gap between a recording surface of a recording material and recording means. For example, in an ink-jet recording apparatus, in order to obtain clear images with high quality, it is ideal that the gap between an ink-ejection face of a recording head and a recording surface of a recording material be as small as possible and be equal as possible over the entire recording surface of the recording material.

In view of roughness of a recording surface of a recording material, however, in order to avoid ink stain of recorded images and recording head wear due to the friction between the recording head and the recording material, an appropriate gap between the recording head and the recording surface of the recording material has to be maintained.

For that purpose, in inkjet recording apparatuses for ink-jet recording on recording materials with various thicknesses such as plain paper and postcards, in order to maintain a predetermined gap between the recording head and the recording surface of the recording material, there are provided a system in which the recording head is displaced in any one of directions approaching and separating from the recording material and a system in which the recording material is displaced in any one of directions approaching and separating from the recording head. In any one of the systems adopted, the gap (referred to as the "head gap" below) between an ink-ejection face of a recording head and a base position, which is the back surface of the recording material opposite to the recording surface adopted as a base point (or a position for supporting the recording material of a platen adopted as a base point), is adjusted so as to correspond to recording material with various thicknesses. For example, in an ink-jet recording apparatus in which the back surface of the recording material is supported by the platen, the gap between the platen and the recording head (that is, the gap between the recording head and the platen position for supporting the back surface of the recording material, which is to be the head gap) is adjusted so as to correspond to the thickness of the recording material.

As positions for setting the head gap, there are generally two positions of a "thin-paper position" for setting the head gap smaller according to plain paper and high-quality media and of a "thick-paper position" for setting the head gap larger according to recording material having thicknesses larger than those of the plain paper such as envelopes and postcards.

When forming images on a plain paper sheet by ejecting ink drops with high density, the surface of a recording material is liable to deform so as to curl to have roughness thereon due to paper swelling, so that the recording material and the recording head may rub against each other. In such a case, even when the recording material is plain paper equivalent to thin paper, the head gap position for thick paper (thick-paper position) may be set and a user may freely switch the head gap position according to situations.

In the conventional example described above, however, although a user can freely switch the head gap position, even when better images could be obtained by using a smaller head gap, the user may leave the head gap at the thick-paper position, so that images with inferior quality may be consequently output.

In particular, when forming images by ejecting ink at both forward and reverse scans during reciprocation of a carriage, when a position other than the optimum position is selected, the positions of ink drops depositing on the recording material in the forward scan may deviate from those in the reverse scan, so that excellent images may not be obtained.

When the larger head gap is preferable in such cases as for envelopes and postcards, if a user performs recording by leaving the head gap at the thin-paper position, the recording head may come into contact with the recording material, which may result in having recorded images stained with ink.

In order to prevent such problems in advance, a system for detecting a recording-operation state such as a head gap state has been demanded, and a simplified detecting system using the structure of a conventional recording apparatus as much as possible is especially required as such a system.

SUMMARY OF THE INVENTION

In view of the problems described above, the present invention has been made, and it is an object of the present invention to provide a recording apparatus, in which a position of a movable end of a carriage moving serially corresponds to a recording-operation state of the recording apparatus.

It is another object of the present invention to provide an ink-jet recording apparatus, in which a gap between a recording head and the back surface of a recording medium or a platen part for supporting the recording medium corresponds to a position of a carriage for moving a recording head mounted thereon serially.

It is another object of the present invention to provide an ink-jet recording apparatus which detects or recognizes the existence of a gap between a recording head and the back surface of a recording medium or a platen part for supporting the recording medium, and the apparatus can record the optimum images according to the gap which is a head-gap distance.

It is another object of the present invention to provide an ink-jet recording apparatus or an ink-jet recording method, a carriage for serially moving a recording head, position detecting means for detecting the position of the carriage in the serial direction, and changing means for adjusting the distance between the recording head and a recording medium, and wherein the apparatus performs image recording according to the distance by detecting a state of the changing means on the basis of information from the position detecting means.

It is another object of the present invention to provide a recording apparatus, a carriage for serially moving a recording head, changing means for changing the movement of the carriage according to a recording state of the recording apparatus, position detecting means for detecting a position of the carriage in the serial direction, and recognizing means for recognizing a recording state of the recording apparatus by detecting a serially movable range of the carriage from the position of the carriage detected by the position detecting means.

Further objects, features and advantages of the present invention will become apparent from the following description of the preferred embodiments with reference to the attached drawings.

DESCRIPTION OF THE PREFERRED EMBODIMENTS

The present invention will be described in detail below by illustrating embodiments with reference to the drawings.

[First Embodiment]

Figure 1:
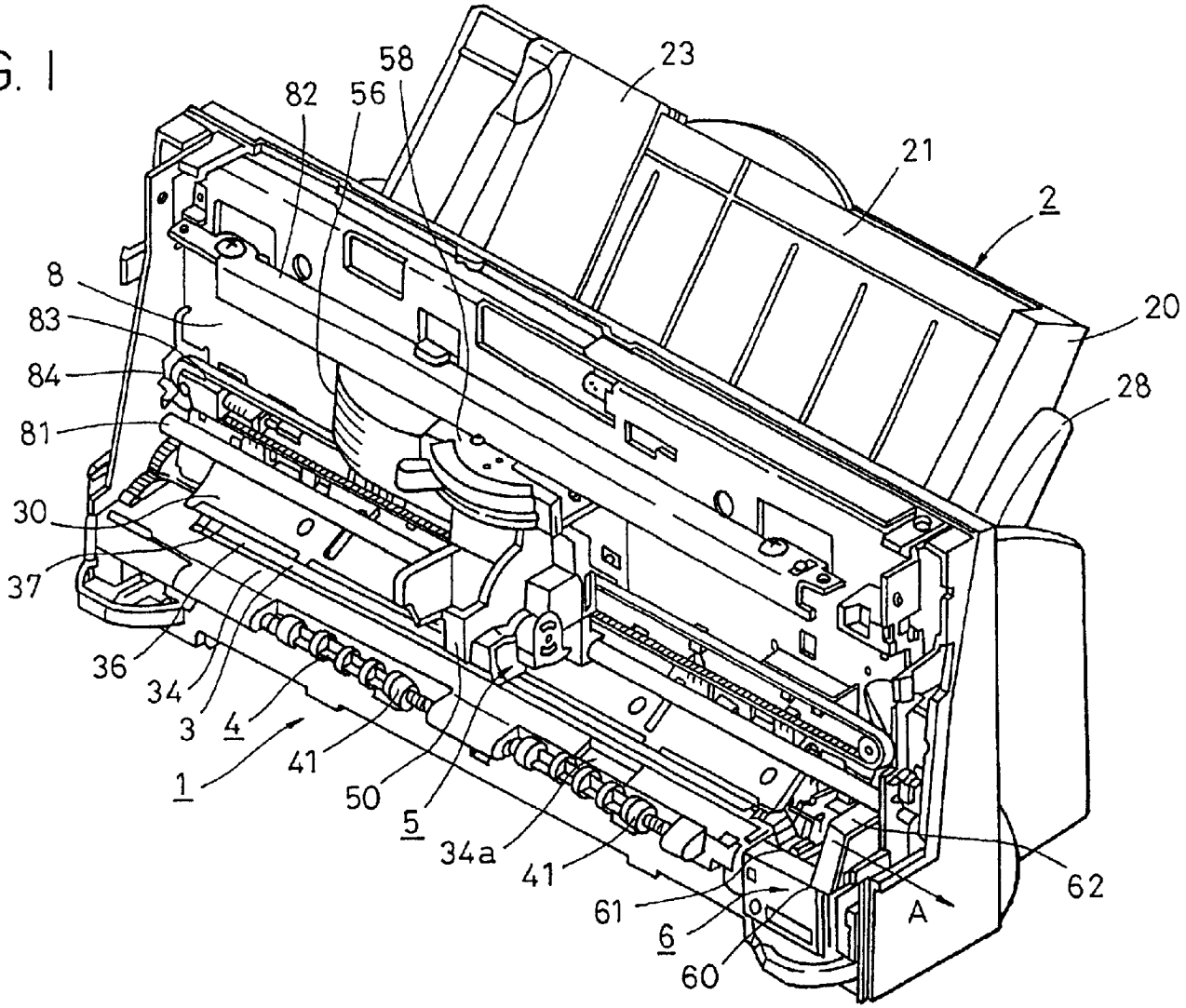
FIG. 1 is a perspective view of the entire structure of a recording apparatus according to an embodiment of the present invention.
Figure 2:
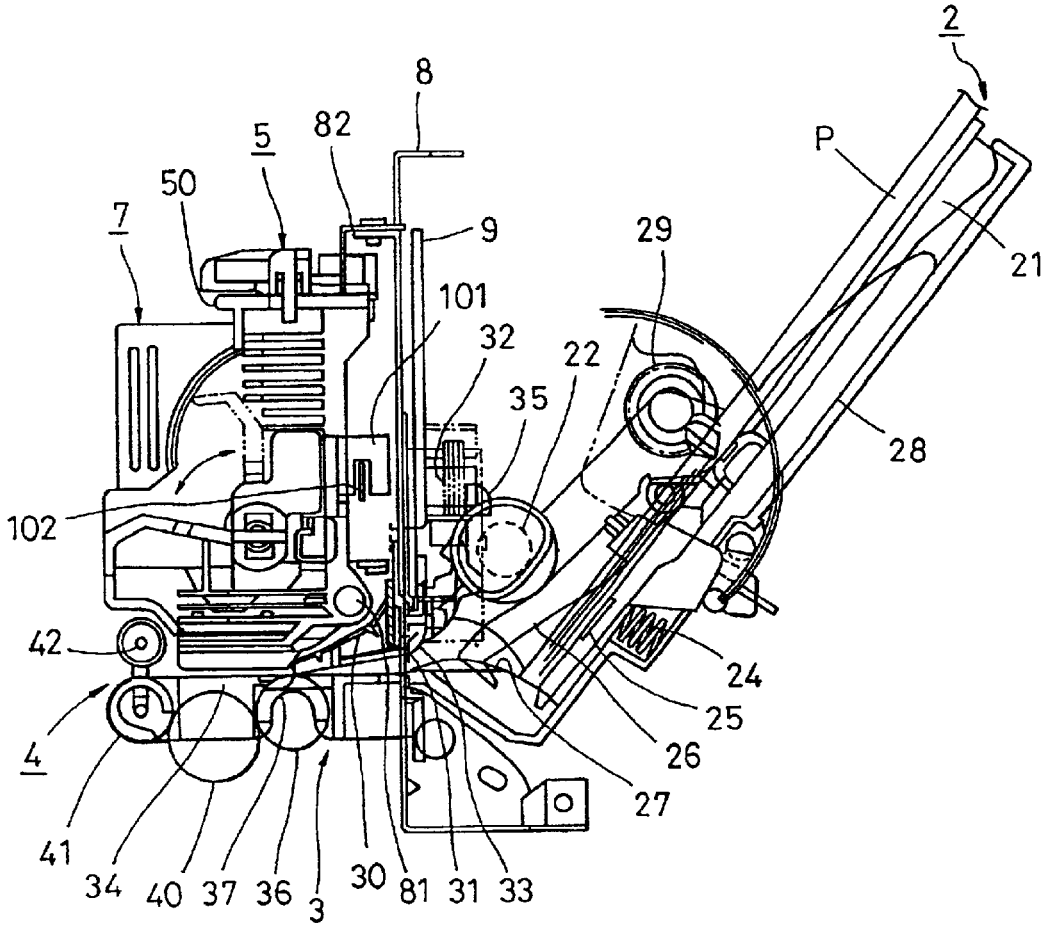
FIG. 2 is a front view of the inside of the apparatus shown in FIG. 1.
Figure 3:
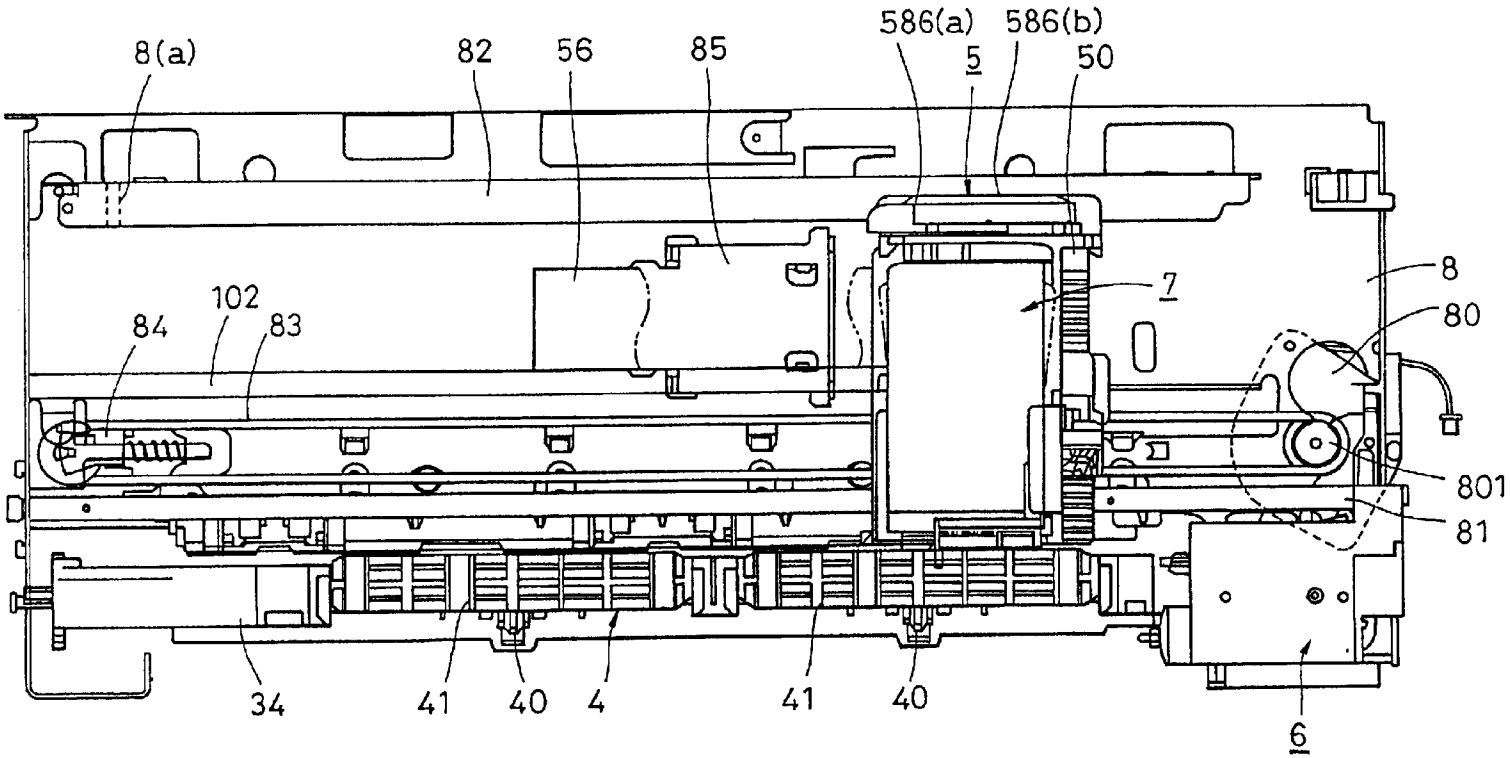
FIG. 3 is a sectional side view of the apparatus shown in FIG. 1.

First, the schematic structure of a recording apparatus according to the present invention is shown in FIGS. 1 to 3.

FIG. 1 is a perspective view showing the entire structure of the recording apparatus; FIG. 2 is a front view of the recording apparatus; and FIG. 3 is a sectional-side elevation of the recording apparatus.

The recording apparatus 1 having an automatic feeder is 1Q formed of a paper feeding section 2, a paper transfer section 3, a sheet discharge section 4, a carriage section 5, to and a cleaning section 6. The outlines of these sections will be sequentially described item by item.

(A) Paper feeding section

In FIGS. 1 to 3, the paper feeding section 2 comprises a base 20 to which a pressure plate 21 for stacking recording sheets P as recording media and a feeding roller 22 for feeding the recording sheets P are attached. In the pressure plate 21, a slidable side guide 23 is movably provided for restricting the stacking position of the recording sheets P. The pressure plate 21 is rotatable about a shaft connected to the base 20 and is urged to the feeding roller 22 by a pressure-plate spring 24. The part of the pressure plate 21 opposing the feeding roller 22 is provided with a separating pad 25 made from a material with a high coefficient of friction such as synthetic leather for preventing piled-up feeding of the recording sheets P. Furthermore, the base 20 is provided with a separating claw 26 for separating the recording sheets P into every one sheet by covering a corner in one direction of a cut recording sheet P, a bank 27 integrally formed with the base 20 for separating recording sheets that cannot use the separating claw 26, such as thick-paper sheets, a switching lever 28 for switching the separating claw 26 between operating at the plain paper position (thin-paper position) and operating at the thick-paper position, and a release cam 29 for releasing the abutment between the pressure plate 21 and the feeding roller 22.

In the structure mentioned above, the release cam 2 pushes down the pressure plate 21 to a predetermined position in a standby state. The abutment between the pressure plate 21 and the feeding roller 22 is thereby released. When a driving force of a transfer roller 36 is transmitted to the feeding roller 22 and the release cam 29 via gears, etc., the release cam 29 is separated from the pressure plate 21. Thereby, the pressure plate 21 moves upwardly and the feeding roller 22 abuts the recording sheet P so as to pick up the recording sheet P along with the rotation of the feeding roller 22 and to start the paper feeding. The recording sheets P are separated into every one sheet by the separating claw 26 so as to feed the sheet to the paper transfer section 3.

After feeding the recording sheets P to the paper transfer section 3, the feeding roller 22 and the release cam 29 are switched again to the standby state, in which the abutment between the recording sheet P and the feeding roller 22 is released, and the driving force from the transfer roller 36 is also cut off.

(B) Paper transfer section

The paper transfer section 3 comprises the transfer roller 36 for transferring the recording sheets P and a PE sensor 32. The transfer roller 36 is provided with a follower pinch-roller 37 abutted thereto. The pinch roller 37 is held to a pinch-roller guide 30 and is urged in contact with the transfer roller 36 by a pinch-roller spring 31 to thereby generate a force for feeding the recording sheets P. Furthermore, at an inlet of the paper transfer section 3 to which the recording sheets P are fed, an upper guide 33 for guiding the recording sheets P and a platen 34 are arranged. The upper guide 33 is provided with a sensor lever 35 for transmitting the detection of leading and trailing edges of the recording sheet P to the PE sensor 32. A head cartridge 7 as recording means for ejecting ink from an ink nozzle so as to form images on the basis of image information is arranged in the downstream side of the transfer direction of the recording sheets (transfer direction of the recording media).

In the structure described above, the recording sheet P fed to the paper transfer section 3 is transferred to a pair of the transfer and pinch rollers 36 and 37 guided by the platen 34, the pinch-roller guide 30, and the upper guide 33. At this time, the sensor lever 35 detects the edge of the recording sheet P transferred thereto to thereby obtain the printing position on the recording sheet P. The recording sheet P is also transferred on the platen 34 by the rotation of the pair of rollers 36 and 37 driven by an LF motor (not shown).

In addition, an ink-jet-recording head is used in this case as the head cartridge 7, which is made integrally with an ink tank so as to be readily replaceable; however, it is not limited to this, and it may be a type that the ink tank and the ink-jet-recording head are separable from each other. The head cartridge 7 can add heat to ink with a heater, etc. The ink is film-boiled due to the heat and the ink pressure is changed by growth or contraction of bubbles due to the film boiling, so that the ink is ejected from a head nozzle so as to form images on the recording sheet P.

(C) Carriage section

The carriage section 5 comprises a carriage 50 for mounting the head cartridge 7. The carriage 50 is supported by a guide shaft 81 for back-and-forth scanning in a direction intersecting the transfer direction of the recording sheet P, which is the direction orthogonal thereto, for example, and a guide rail 82 for maintaining the gap between the recording head 7 and the recording sheet P by holding the upper rear-end of the carriage 50. In addition, the guide shaft 81 and the guide rail 82 are attached to a chassis 8.

The chassis 8 is provided with a restricting portion 8(*a*) raised by bending for restricting the left-side moving range of the carriage.

The carriage 50 is driven by a carriage motor 80 attached to the chassis 8 via a timing belt 83. The timing belt 83 is looped and stretched by an idle pulley 84. Furthermore, the carriage 50 is provided with a flexible cable 56 for transmitting a head signal from an electric substrate 9 to the head cartridge 7. The carriage 50 is equipped with a linear encoder 101 which can detect the carriage position by reading the number of lines of a linear scale 102 attached to the chassis 8. The signal of the linear encoder 101 is transmitted to the electric substrate for processing via the flexible cable 56.

In the structure described above, when forming images, the recording sheet P is transferred to a line position (a position in the transfer direction of the recording sheet P) for image-forming by the pair of rollers 36 and 37, while the carriage 50 is moved to a row position (a position orthogonal to the transfer direction of the recording sheet P) for image-forming by the carriage motor 80 which is feedback-controlled using the linear encoder 101. The head cartridge 7 is thereby moved to a position opposing the image-forming position.

Then, the head cartridge 7 ejects ink toward the recording sheet P by the signal from the electric substrate 9.

(D) Sheet discharge section

In the sheet discharge section 4, the transfer roller 36 abuts a transmitting roller 40 which in turn abuts a discharge roller 41. Therefore, the driving force of the transfer roller 36 is transmitted to the discharge roller 41 via the transmitting roller 40.

As a follower roller for discharge which is rotatable by following the discharge roller 41, a spur 42 abuts the discharge roller 41.

By the structure described above, the recording sheet P having images formed thereon at a position in which the carriage section 5 opposes the platen 34 is conveyed by the nip between the discharge roller 41 and the spur 42 so as to be discharged into a discharge tray (not shown).

(E) Cleaning section

The cleaning section 6 comprises a pump 60 for cleaning the head cartridge 7, a cap 61 for checking the drying of the head cartridge 7, and a drive-switching arm 62 for switching the driving force from the transfer roller 36 between the paper feeding section 2 and the pump 60. During the period of time other than the paper feeding and the cleaning, the drive-switching arm 62 fixes a planet gear (not shown) rotating about the axis of the transfer roller 36 to a predetermined position, so that the driving force is not transmitted to the paper feeding section 2 and the pump 60. When the drive-switching arm 62 is moved in the arrow A direction by the movement of the carriage 50, the planet gear is moved according to one of the normal and the reverse rotations of the drive-switching arm 62. In the normal rotation, the driving force is transmitted to the paper feeding section 2, while in the reverse rotation, the driving force is transmitted to the pump 60.

(F) Head-gap adjusting section

Next, embodiments of a head-gap adjusting section according to the present invention will be described in detail.

Figure 4:
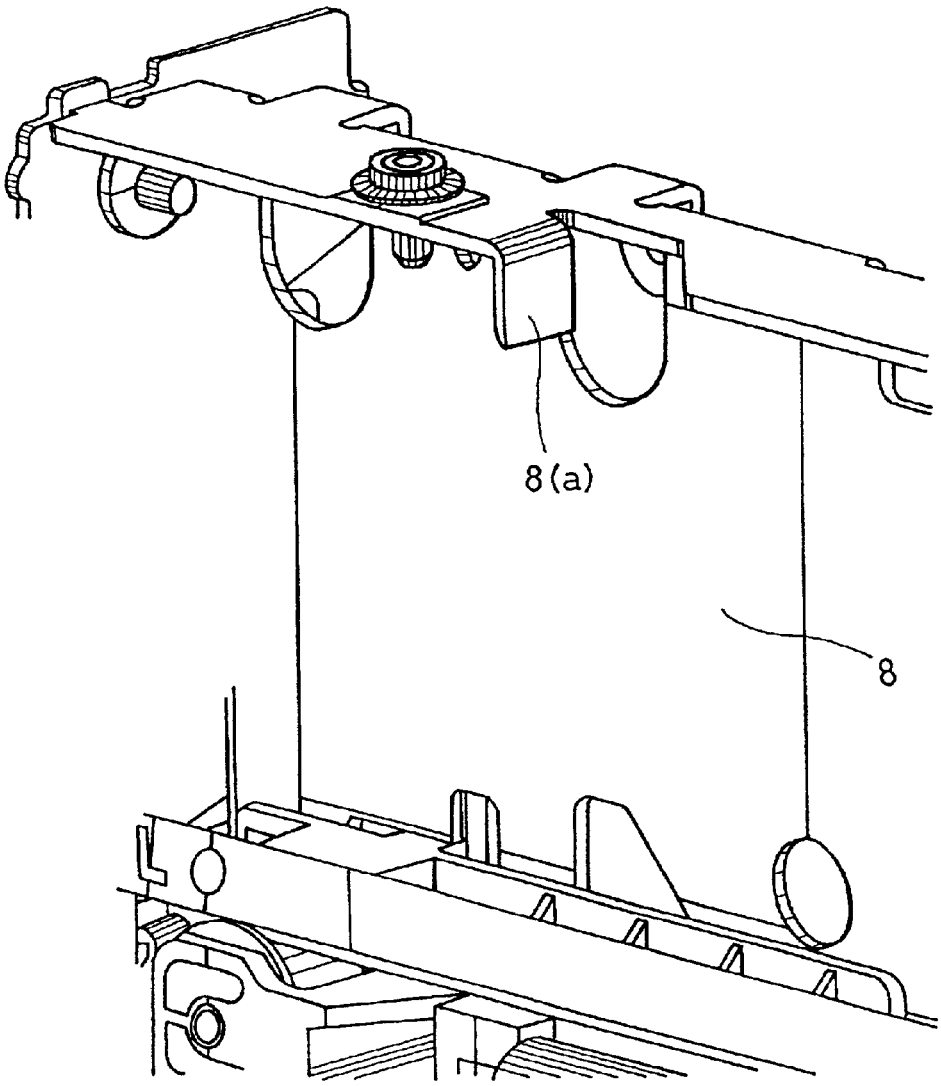
FIG. 4 is a perspective view of a restricting portion of the apparatus shown in FIG. 1.
Figure 5:
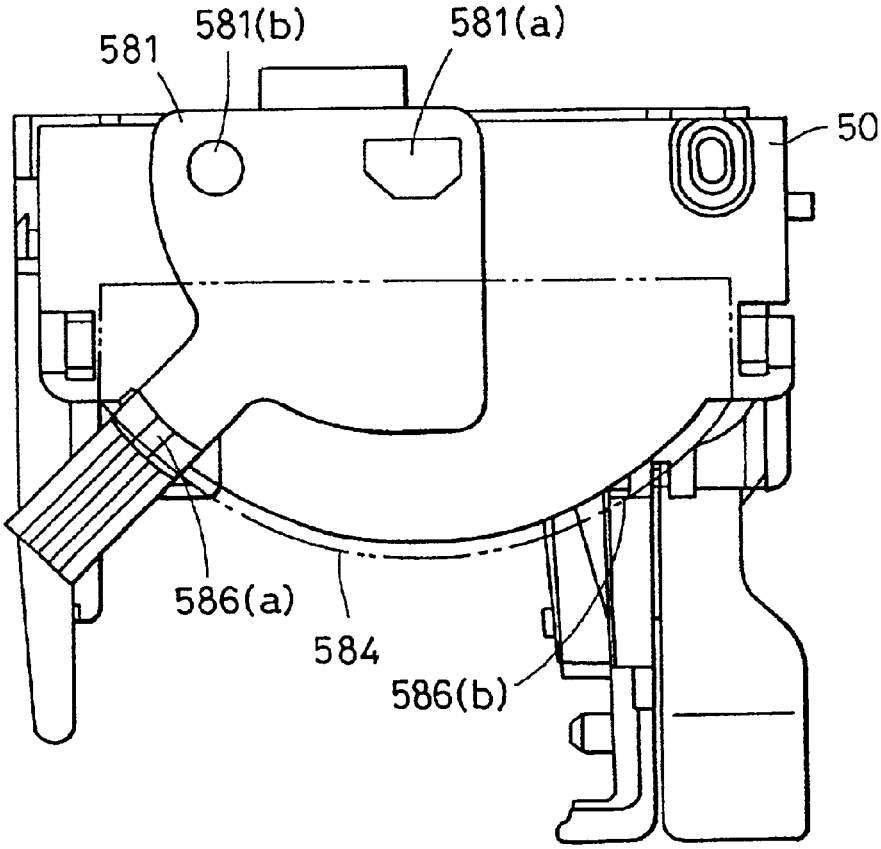
FIG. 5 is a top plan view of a carriage (at thin-paper position) of the apparatus shown in FIG. 1.
Figure 6:
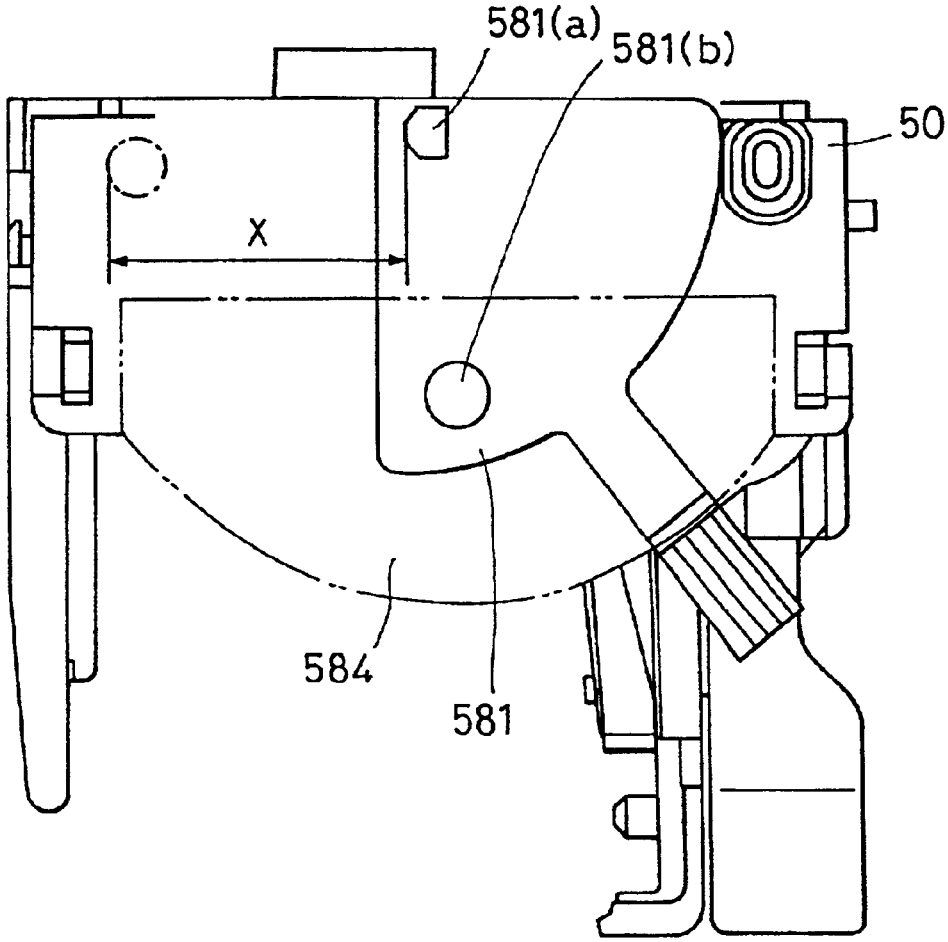
FIG. 6 is a top plan view of the carriage (at thickpaper position) of the apparatus shown in FIG. 1.
Figure 7A:
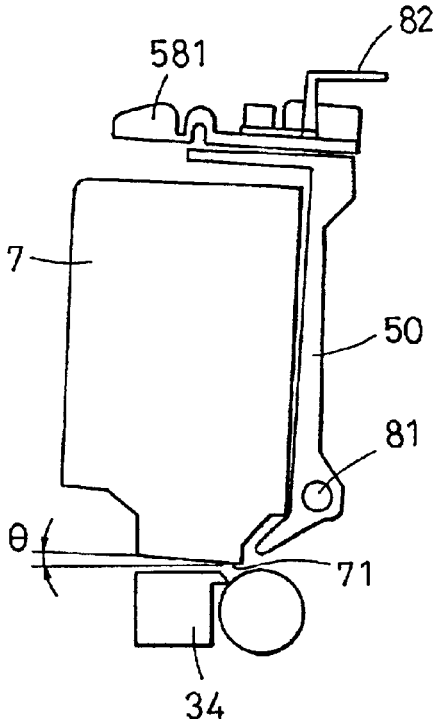
FIGS. 7A and 7B are sectional-side schematic views showing the relationship between a head cartridge and a platen at different head-gap positions.
Figure 7B:
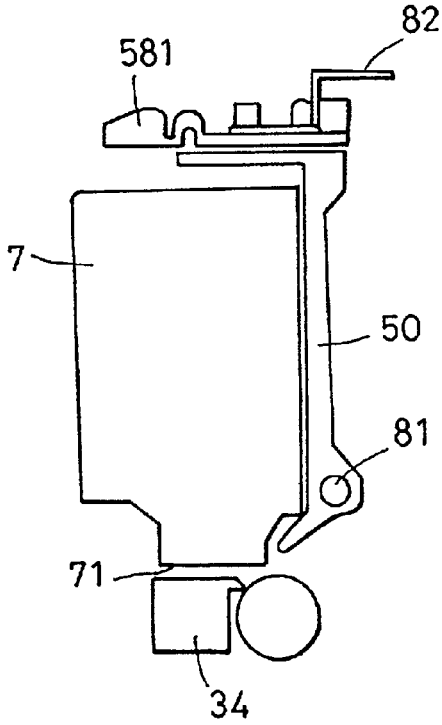

FIG. 4 is a perspective view of a restricting portion showing the restricting portion 8(*a*) when the guide rail 82 is removed in the apparatus described above; FIG. 5 is a plan view of the carriage section 5; and FIG. 6 is a schematic sectional side elevation showing the relationship between the head cartridge and the platen at the head-gap position in the apparatus.

As is shown in FIGS. 1 to 3, the carriage section 5 is a unit in which various parts are attached to the carriage 50. The upper part of the carriage 50 is provided with a head-gap adjusting section 58 for adjusting the gap between the head cartridge 7 and the recording sheet P. The head-gap adjusting section 58, as shown in FIG. 5, comprises an adjusting lever 581 and a top cover 584. The adjusting lever 581 is made to be rotatable by inserting a pin into a hole formed in the carriage 50. The adjusting lever 581 is provided with a polygonal sliding member 581(*a*) having a sliding surface arranged in a side-face, in which the distance to the rotational center of the adjusting lever 581 is different according to the number of head-gap positions. The sliding surface of the sliding member 581(*a*) sliding with the guide rail 82 is changed by rotating the adjusting lever 581, and in accordance therewith, the carriage 50 is rotated about the guide shaft 81 so as to change the head gap. The adjusting lever 581 is also provided with a boss 581(*b*) which is to be a member for restricting the left-side moving range of the carriage 5 according to the position of the adjusting lever 581.

The top cover 584 of the carriage is fixed by claws formed on both sides of the carriage 50 so as to hold the adjusting lever 581. The lever end of the adjusting lever 581 has elasticity, and a projection 586(*a*) formed on the top face of the adjusting lever 581 is brought into engagement with one of two grooves 586(*b*) formed on the backside of the top cover 584 indicated by a phantom line in FIG. 5 so as to fix the adjusting lever 581 to a position corresponding to one of two predetermined plain paper (thin paper) and thick paper positions. In addition, the relationship between the groove and the projection may be the reverse, and furthermore, it is not limited to the structure described above as long as it can retain the adjusting lever 581 at a predetermined position of the top cover 584.

As described above, the projection 586(*a*) and the two grooves 586(*b*) are head-gap adjusting mechanisms which respectively correspond to a thin recording medium, such as so-called plain paper, and a recording medium with a thickness larger than a predetermined value, such as a postcard or an envelope. In the embodiment, two values are set, that is, the gap between the recording head and the platen is set to 1.0 mm according to the head gap at the thin-paper position while it is set to 2.0 mm corresponding to the thick-paper position. When setting such values, at the thin-paper position, the distance between the recording surface of the recording sheet (0.1 to 0.2 mm thicknesses are supposed approximately) and the recording head may be 0.8 to 0.9 mm approximately. At the thick-paper position, although the distance between the recording sheet and the recording head is largely changed according to the kind of the recording sheet, it may be 1.8 to 1.6 mm approximately in the case of the postcard (0.2 to 0.4 mm thicknesses are supposed approximately). The reason of such setting is that the recording surface of the thin sheet has small roughness of the recording surface and can excellently follow a platen supporting-face for supporting the back-face of the sheet and is difficult to rise therefrom, while the thick recording sheet such as a postcard has roughness on the top surface larger than the thin paper and is liable to rise from the platen due to the rigidity of the recording sheet itself. That is, the reason is that in the thick recording sheet with thickness larger than that of the thin recording sheet, the distance between the recording surface and the recording head is set rather larger for allowing a margin. Therefore, it is preferable to make adjustment of the ink-ejection timing, which will be described later, in order to obtain recorded images with higher quality.

Also, in the carriage section 5, the guide shaft 81 attached to the chassis 8 is inserted into bearings of the carriage 50, and on the guide rail 82 attached to the chassis 8, the adjusting lever 581 and a pressure lever 582 are allowed to slide, enabling to make back-and-forth scanning.

On the back-face of the carriage 50, the timing belt 83 is attached, which is looped and stretched between a pulley 801 attached to the shaft of the carriage motor 80 arranged in the chassis 8 and the idle pulley 84 attached to the chassis 8.

The linear encoder 101 equipped in the carriage can precisely detect the carriage position by reading the number of lines of the linear scale 102 even during the movement of the carriage, and moreover, when the signal output is not changed even when the carriage motor 80 is driven for a fixed period of time, it can be detected that the carriage cannot move beyond this position (carriage position at which the output change is lastly detected), that is, the serial-movement range of the carriage can be detected.

In the recording apparatus according to the embodiment, during initialization, the home position is determined to be a position at which the carriage 5 comes to the end to stop when it is moved toward the right face of the chassis 8. Similarly, the position opposite to the home position (referred to as the non-home position side below) is determined to be a position at which the signal output of the linear encoder 101 is not changed when the carriage 5 is moved toward the left face.

When the head gap is at the thin-paper position, as shown in FIG. 5, the boss 581(*b*) is located in the left side of the sliding surface 581(*a*) in the scanning direction of the carriage 5. When the carriage 5 is moved in the left side, the boss 581(*b*) is abutted to the restricting portion 8(*a*), which is arranged to be abuttable to the boss 581(*b*) with the scanning of the carriage 5, as shown in FIG. 4, so that the movement range is determined.

When the head gap is at the thick-paper position, as shown in FIG. 6, the boss 581(*b*) is located in the right side of the sliding surface 581(*a*) in the scanning direction of the carriage 5. When the carriage 5 is moved in the left side, a part of the sliding surface 581(*a*) is abutted to the restricting portion 8(*a*).

It is shown in FIG. 6 that the movable-range difference between the thin-paper position and the thick-paper position is X. When A denotes the designed value of the movable range at the thin-paper position, it is determined to be at the thick-paper position when the movable range is more than (A+X/2), and to be at the thin-paper position when being not more than that. At this time, the value X may preferably be sufficiently large relative to the respective dimensional tolerances and dimensional changes due to temperature changes of the chassis 8, the linear scale 102, the carriage 5, and the boss 581(*b*), and when it is not sufficient enough, the wrong determination may be made.

Next, because the distance between the recording surface and the recording head at the thin-paper position is different from that at the thick-paper position, as described above, it is preferable that the ink-ejection cu timing when two-way recording be corrected on the basis of the determined head gap. If the timing of ink drops impacting the recording surface when forward recording (when the carriage moves from the left to the right viewed in FIG. 2) is a standard, when the impact timing in the backward recording at the thin-paper position is equalized to that at the thick-paper position, the forward recording is deviated from the backward recording. The amount of the deviation on calculation is:

$$(\Delta d/V_d)\times V_c[\text{mm}],$$

wherein the ink ejecting speed is $V_d$[mm/s], the scanning speed of the carriage is $V_c$[mm/s], and the distance difference between the recording surface and the recording head at each position is Δd [mm].

In the embodiment, for example, when $V_d$=10000 [mm/s] and $$V_c=1000\ [\text{mm/s}],$$

because Δd is 1.0 [mm] approximately when it is large, as described above, an ink deposit positional shift of approximately 0.1 mm is produced. Even when an operator records at the thick-paper position by mistake on a recording sheet to be recorded at the thin-paper position, the deposit positional shift is 0.1 mm because Δd is still 1.0 [mm]. Such a value corresponds to approximately 2.5 dots in terms of 600 dpi, so that deterioration in image quality is clearly recognized when viewing images. Accordingly, when the head gap is at the thick-paper position, it is required for obtaining recorded images with high quality to correct this deposit positional shift during the backward scanning. Specifically, in the embodiment, ejection timing is controlled to advance by 0.1/1000=0.0001 [sec] (0.1 msec) when the deposit positional shift is 0.1 mm.

As described above, because errors are reduced by switching the position of the adjusting lever 581 so as to change the movement range of the carriage, mistakes of position determination can be extremely reduced. By optimizing the ejection timing based on determined results, a user can readily obtain images with high quality even at the thick-paper position.

[Second Embodiment]

In the first embodiment, the adjusting lever 581 is mounted on the carriage 5, so that it is required for operating the adjusting lever 581 to perform an opening and closing operation of an outer cover (not shown) arranged to cover the movement range of the carriage.

In this embodiment, by utilizing the opening and closing operation of the outer cover, the timing for detecting the head-gap state is established. Other structures of an ink-jet recording apparatus according to the embodiment are the same as those of the first embodiment described above.

In the ink-jet recording apparatus, when replacing the head cartridge 7 mounted on the carriage 5, the carriage 5 is moved from the armored (or covered) home position of the carriage to an opening (covered by the openable and closeable outer cover mentioned above) formed at the substantially center position of the scanning range of the carriage so as to offer the convenience in the replacement of the head cartridge 7. The movement of the carriage is performed based on the detection of the opened state of the above-mentioned outer cover arranged at the substantially center position of the scanning range of the carriage.

In the embodiment, the detection of the head-gap state is only carried out when the outer cover is closed as well as when the power supply is turned on. In the first embodiment described above, before the recording, in order to check the position of the adjusting lever 581, the step of the carriage movement for confirming the scannable range of the carriage is always performed; however, in this embodiment, the position of the adjusting lever 581 is considered to be not changed as long as the opening and closing operation of the outer cover is not performed, so that it is sufficient to confirm the setting state of the head gap at least once when turning on the power supply, resulting in the reduction of the number of steps of the carriage operation for the detection of the head-gap state.

[Third Embodiment]

In the first embodiment, the detection of the scanning range is performed based on the output of the linear encoder; according to this embodiment, the present invention is applied to an ink-jet recording apparatus having a pulse motor as a driving source and not having the linear encoder. Other structures thereof are the same as those of the first embodiment described above.

In the apparatus, a controller is provided with a circuit for detecting an out-of-controlled-action state of the pulse motor. The carriage 5 is stopped by the restriction of the restriction portion 8*a* at an end of the scannable range while being driven by the pulse motor, so that the scannable range of the carriage 5 is detected by the detecting circuit which counts the number of pulses until the out-of-controlled-action state of the pulse motor produced by the stoppage.

Thereby, the head gap state is recognized by switching the adjusting lever 581 so as to detect changes in the scanning range of the carriage, so that an apparatus using a pulse motor can also be applied to the present invention.

[Fourth Embodiment]

In the third embodiment described above, changes in the scanning range of the carriage caused along with the operation of the adjusting lever 581 are detected based on occurrence of the out-of-controlled-action state of the pulse motor; in this embodiment, photo-sensors or microswitches are arranged over the scanning range of the carriage 5 so as to detect on/off of the change. Other structures of an ink-jet recording apparatus according to this embodiment are the same as those of the third embodiment described above.

Thereby, an ink-jet apparatus without a linear encoder or an ink-jet apparatus without a pulse motor or without a circuit for detecting an out-of-controlled-action state of a pulse motor can also be applied to the present invention.

[Fifth Embodiment]

In the first embodiment, the carriage 5 is abutted to the right side of the chassis 8 so as to detect the fiducial or reference position during initialization of the printer, and the restricting portion 8(*a*) for abutting the boss 581(*b*) of the adjusting lever 581 is arranged at the left side of the chassis 8. The carriage 5 therefore has to be moved from the right end to the left end of the scanning range of the carriage in order to detect the head-gap state.

In an ink-jet recording apparatus according to this embodiment, a sensor for detecting a fiducial position is provided for more rapid detection of the head-gap position. Specifically, the fiducial-position-detecting sensor for detecting the home position of the carriage is arranged in the vicinity of the right end of the scanning range of the carriage 5, and a range movable to the right therefrom is arranged so as to place the above-mentioned restricting portion 8(*a*) therein, and the boss 581(*b*) is properly arranged in the adjusting lever 581 so as to enable the boss 581(*b*) to abut the restricting portion 8(*a*).

By such a structure, the adjusted state of the head gap caused by the adjusting lever 581 can be detected as long the carriage 5 is slightly moved further from the home position to the right. Because the head-gap position is detected in such a manner, the period of time from the detection of the fiducial position to the detection of the adjusted state of the head gap can be extremely reduced.

[Sixth Embodiment]

In the first and the second embodiment, the scanning range of the carriage 5 is changed by operating the adjusting lever 581 mounted on the carriage 5; an ink-jet recording apparatus according to this embodiment is provided with a lever for adjusting the head gap which is exposed outside the apparatus so as to adjust the head gap without the opening and closing operation of the outer cover, and a lever member is arranged outside the apparatus armor for changing positions of guide members such as the guide shaft 81 for slidably supporting the carriage 5 and the guide rail 82.

In the ink-jet recording apparatus according to this embodiment, while eccentric bearings (not shown) are arranged at both ends of the guide shaft 81, an operating lever for adjusting the head gap (not shown) is arranged outside the apparatus armor so as to fit the guide shaft 81, and the eccentric bearings are rotated by rotating the operating lever so that the guide shaft 81 is vertically displaced so as to change the head gap according to one of the thin-paper position and the thick-paper position. At this time, the restriction portion 8(*a*) is structured so that it abuts the boss 581(*b*) in the height of the carriage 5 at the thin-paper position but it cannot abut the boss 581(*b*) in the height of the carriage 5 at the thick-paper position. In this case, prior to the recording, the head-gap position of the lever for adjusting the head gap is detected from the movable range of the carriage 5 by scanning the carriage 5.

By such a structure, the head-gap position can be switched only by operating the lever for adjusting the head gap without the opening of the armor by a user. Also, since the guide shaft is vertically moved, the head gap can be vertically changed while maintaining the parallel faces of the head-gap, resulting in further improvement of images when the head gap is large.

[Seventh Embodiment]

In the first to the sixth embodiment, the scanning range which is originally not necessary is provided for detecting the head gap; however, a member for restricting the scanning range of the carriage 5 may enter into the normal scanning range except during the recording.

In an ink-jet recording apparatus according to this embodiment, the cleaning section is provided with a restricting member which can be displaced to a position abuttable to the scanning carriage 5 and can be also displaced to a position not abuttable to the carriage 5 by retracting from the abuttable position, so that the restricting member enters thereinto only when detecting the head-gap position. In addition, the restricting member may be arranged not only in the cleaning section but also at a position penetrable into the scanning range of the carriage 5.

By the structure according to the embodiment, an ink-jet recording apparatus capable of detecting the head-gap state can be obtained while maintaining the same size of the scanning range as that of a conventional apparatus.

[Other Embodiments]

In addition, as configurations of a recording apparatus according to the present invention, there may be provided a copying apparatus combined with a reader and a facsimile apparatus having input and output functions as well as an image-output terminal, which is provided integrally or independently, of an information processing apparatus such as a computer.

As described above, according to the embodiments, an ink-jet recording apparatus can be obtained in which the gap between the platen and the recording head (the gap between the part of the platen for supporting the back surface of a recording medium and the ink-ejecting part of the ink-jet recording head), i.e., the size of the head gap, is detected or recognized by the recording apparatus so as to perform the optimum image recording according to the size of the head gap.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An inkjet recording apparatus comprising:

a carriage for serially moving a recording head for ejecting ink drops;

a guide rail for guiding serial movement of said carriage;

an adjusting lever for changing the width of a gap between the recording head and a platen, wherein said adjusting lever slides along said guide rail when said carriage is moving; and a linear sensor for detecting a position of said carriage in a serial direction, wherein a movable range of said carriage is changed by operation of said adjusting lever and the state of said adjusting lever is judged from the movable range, which is detected by said linear sensor.

2. An apparatus according to claim 1, further comprising control means for changing ink-drop-ejection timing based on the state of said adjusting lever.

3. An apparatus according to claim 1, wherein the movable range includes a reference position for use as a positional reference of said carriage, and a movable end of said carriage is displaced toward a side opposite to the reference position by operating said adjusting lever.

4. An apparatus according to claim 1, wherein the movable range includes a reference position for use as a positional reference of said carriage, and a movable end of said carriage is displaced toward a same side as the reference position by operating said adjusting lever.

5. An apparatus according to claim 1, further comprising a cover member opened openable in order to operate said adjusting lever and a cover sensor for detecting opening of said cover member, wherein changes in the movable range of said carriage are detected by said linear sensor when said cover member is closed.

6. An apparatus according to claim 1, further comprising an electrical power supply for driving the recording apparatus, wherein changes in the movable range of said carriage are detected by said linear sensor when the electrical power supply is turned on.

* * * * *

UNITED STATES PATENT AND TRADEMARK OFFICE

CERTIFICATE OF CORRECTION

PATENT NO. : 6,834,925 B2
DATED : December 28, 2004
INVENTOR(S) : Ikeda

It is certified that error appears in the above-identified patent and that said Letters Patent is hereby corrected as shown below:

Column 1,
Line 20, “inkjet,” should read -- ink-jet, --.
Line 46, “inkjet” should read -- ink-jet --.

Column 3,
Line 36, “thickpaper” should read -- thick-paper --.
Line 56, “1Q” should be deleted.
Line 58, “to” should be deleted.

Column 8,
Line 14, “cu timing” should read -- timing --.
Line 16, “If” should begin a new paragraph.

Column 11,
Line 37, “inkjet” should read -- ink-jet --.

Column 12,
Line 27, “opened” should read -- being --.

Signed and Sealed this

Twelfth Day of July, 2005

JON W. DUDAS
*Director of the United States Patent and Trademark Office*